US007028936B2

(12) United States Patent
Condon

(10) Patent No.: US 7,028,936 B2
(45) Date of Patent: Apr. 18, 2006

(54) WEAR BARS FOR IMPELLERS

(75) Inventor: Gary J. Condon, Irwin, PA (US)

(73) Assignee: Kennametal Inc., Latrobe, PA (US)

( * ) Notice: Subject to any disclaimer, the term of this patent is extended or adjusted under 35 U.S.C. 154(b) by 72 days.

(21) Appl. No.: 10/459,252

(22) Filed: Jun. 11, 2003

(65) Prior Publication Data

US 2004/0251358 A1 Dec. 16, 2004

(51) Int. Cl.
*B02C 19/00* (2006.01)

(52) U.S. Cl. ..... 241/275; 241/300

(58) Field of Classification Search ..... 241/300, 241/275

See application file for complete search history.

(56) References Cited

U.S. PATENT DOCUMENTS

| | | | |
|---|---|---|---|
| 4,140,170 | A | 2/1979 | Baum |
| 4,146,080 | A | 3/1979 | Baum |
| 4,787,564 | A | 11/1988 | Tucker |
| 5,279,902 | A | 1/1994 | Materkowski |
| 5,954,282 | A | 9/1999 | Britzke et al. |
| 6,171,713 | B1 | 1/2001 | Smith et al. |
| 6,399,176 | B1 | 6/2002 | Francois |
| 6,601,789 | B1 | 8/2003 | Bajadali et al. |
| 2003/0025020 | A1 | 2/2003 | Britzke |
| 2003/0213861 | A1 | 11/2003 | Condon et al. |

OTHER PUBLICATIONS

PCT Search Report and Written Opinion mailed Sep. 2, 2004, in PCT/US2004/016972, filed Jun. 1, 2004.

*Primary Examiner*—Mark Rosenbaum
(74) *Attorney, Agent, or Firm*—Matthew W. Smith

(57) ABSTRACT

The present invention is particularly, but not exclusively, useful for reducing wear of component parts of impact-type rock-crushing machines caused by earth aggregate flows during operation of impact crushers. The present invention includes a central feed body and impeller shoe that has hard material insert bars fixed therein to reduce wear. The exposed top surface of the central feed body and front face of the impeller shoe are impregnated with a plurality of cemented carbide insert bars. The cemented carbide insert bars form an upper composite matrix that helps to reduce wear and the premature wash out of the hard material insert bars integrally cast within the central feed body.

16 Claims, 3 Drawing Sheets

WEAR BARS FOR IMPELLERS

BACKGROUND OF THE INVENTION

Regardless of the precise nature or function of an apparatus in which components are subjected to wear by a material flow, wear causes need for repair and replacement of components and delays in use of the apparatus while one or more worn components are identified, inspected, removed, and replaced. Wear of components adds to the expense of maintaining and operating the apparatus.

As a result of persistent wear caused by material flows, components on construction equipment exposed to material flow must be replaced. Replacement of components causes "down time" to repair, refit, and replace components. Additional expenses are associated with replacing the worn part or component, inventorying replacement components, and delivering a replacement component to what is often a remote site.

For example, a wide variety of impact rock crushers are used in commerce to reduce the size of larger earth materials to smaller sized aggregate. The construction industry trades employ a variety of impact crushers to reduce large aggregate to aggregate sizes and shapes required to satisfy construction specifications for mixtures and admixtures of aggregate with cement and other ingredients and for further processing of size reductions, chemical leaching, and other stages of use. The construction industry's use of impact crushers is but one example of the need to reduce wear caused by a materials flow in an apparatus used to effect the size of aggregate in the materials flow, to make substantially uniform the size of aggregate in a materials flow, and to prepare materials for further processing.

Generally, impact rock crushers provide a device for introducing aggregate into a device for crushing the aggregate. Many impact crushers are designed to rely on centrifugal force to disperse large aggregates through the crusher and to impact the aggregate against a wide variety of impact crusher components to break up, reduce in size, and ultimately eject from the crusher, aggregates composed of desired shapes, sizes, and consistency.

Impeller impact rock crushers may include but are not limited to one impeller table, having a central feed body and impeller shoes attached to an impeller assembly. The shoes, in combination with centrifugal force, hurl and direct an aggregate flow generated by operation of an impeller assembly against one or more anvils located within the crusher. Both the central feed body and impeller shoes on the impact impellers are subjected to substantial wear caused by material flow.

The front face of prior art impeller shoes are radially oriented with respect to the central axis of the impact impellers. The impeller shoes change the velocity of the material flowing outwardly along the impeller table due to centrifugal force. The accelerating mass of the material applies a substantial force vector normal to the surface of the shoe. The normal force against the surface of the shoe results in high friction and high wear rates of the shoe.

Efforts have been devoted to improvements in the design and construction of components of impact crushers to reduce the cost of acquiring and operating crushers, to enhance wear resistance of the component parts of crushers, and to facilitate rapid replacement of worn parts of crushers to enable the user of crushers to lose the least possible amount of time during which a crusher is inoperative due to worn parts.

Such improvements are exemplified by U.S. Pat. No. 5,954,282 issued Sep. 19, 1999. The Britzke et al. patent is instructive on describing how components in an impact crusher are exposed to wear during operation of an impact crusher. All components of an impact crusher exposed to a material flow of aggregate, as exemplified in Britzke et al. U.S. Pat. No. 5,954,282 and other impact crushers, are subject to abrasion, decomposition, fracture, friction, impact, pulsation, wave action, grinding, and other actions causing wear to components of an impact crusher this is due to the velocity, acceleration and composition of aggregate flows against, across, and around the components during operation of a crusher (collectively, "wear").

U.S. Pat. No. 5,954,282 to Britzke et al. discloses an impeller assembly including wear resistant rods press fit into bores formed in the vertical crusher assembly. Vertical impact crushers such as U.S. Pat. No. 5,954,282 incorporate a flat central feed disc for receiving material from a hopper. The Briztke et al. '282 U.S. patent employs hard material rods that are interference press fit into bores milled into a ferrous body. The hard material used to construct the rods in the Britzke et al. '282 patent has a much greater wear resistance than the ferrous material used to construct the body.

Prior art impact crushers constructed according to the Britzke et al. '282 disclosure have suffered from drawbacks during operation in the field. The hard material rods in Britzke et al. '282 themselves have proven durable in resisting wear but the ferrous material of the body at 12 in Britzke et al. '282 wears out at a predictably accelerated rate in comparison to the rods. As the exposed surface of the ferrous body that fixes and holds the rods recedes the depth of the bores at 24 in Britzke et al. '282 shorten exposing more of the rod. As the body ferrous material recedes, the interference press fit between the ferrous body and rods shorten and weaken until eventually on account of the weakened joint the rods are then easily knocked out by aggregate. In such impeller plates and impeller shoe designs as described in Britzke et al. '282, the press fit compact wear rods on the impeller shoes and center feed disc prematurely become dislodged by aggregate material. In efforts to protect hard material rods from wash out, prior designs have attempted to position adjacent hard material rods closer together, but have been unsuccessful. In these prior designs it was necessary that the spacing between the rods became so small that the strength and integrity of the ferrous body for receiving and holding (interference fit) the insert rods weakened and softened to the point that the interference fit was insufficiently strong to hold the rods in place.

The "washed out" compact rods are slung against the anvil and other components of the crusher by the centrifugal force generated by the rotating impeller. The hard material rods cause damage to the components of the impeller that are often made of softer materials. These compact rods that broke free of the impeller or shoes were hurled against the anvils and other components of the vertical shaft impeller (VSI) causing accelerated wear and greater damage to the VSI as the compact inserts bounce back and are constantly flung within the impeller against anvils and other components. On occasion such compact inserts would knock loose other compact inserts resulting in more destruction and even greater acceleration of damage within the VSI.

It is an object of the present invention to reduce the frequency of impeller shoe and central feed body maintenance required in the operation of impeller rock crushers. It is believed that the present invention results in saving of expenses resulting from less maintenance labor, cost of replacement components and less down time.

What is needed, therefore, is a cost effective device for reducing the wear rate of components of apparatus subjected to operational wear. Particularly, what is needed is a device for reducing wear of components of an impact aggregate crusher caused by a material flow of aggregate during operation.

SUMMARY OF THE INVENTION

An impeller assembly for crushing earth materials such as rock into desirable shapes and sizes. The impeller assembly assists in projecting and directing an aggregate flow against, over or around another embodiment of a body (e.g., anvil) designed for crushing, fracturing, breaking up and reducing in size and shape large aggregate into smaller sizes and shapes.

It is an object of the present invention to provide components having greater resistance to wear on equipment that is exposed to aggregate flow and/or randomly rebounding aggregate material. The present invention is particularly, but not exclusively, useful for reducing wear of component parts of impact crushers caused by earth aggregate flows during operation of impact crushers. The impeller crusher assembly of the present invention when exposed to material flows during operation of the impact crusher will increase the wear life of components by resisting wear caused by a material flow across, over, and around the impact crusher assembly.

Hard material insert bars are embedded and bonded together in a preselected pattern within a center feed disc body cast from a metal such as air hardened steel. The insert bars are made from a hard material to reduce wear on the surface of the center feed disc.

In one impeller assembly embodiment, both the center feed body housing and the impeller shoe housing are impregnated with a plurality of hard material insert bars extending to or beyond the top surface of the central feed body housing.

The present invention also has hard material insert bars positioned about the outer periphery of a central feed body to protect the peripheral surface of the central feed body from wear attributable to rebounding aggregate material.

Still, another object of the present invention is to provide a design for reducing wear of components of impact crushers during operation and a method for manufacturing wear reducing components which are easy to manufacture, use and to practice and which are cost effective for their intended purposes.

These and other objects, features, and advantages of such components for reducing wear by a material flow will become apparent to those skilled in the art when read in conjunction with the accompanying following detailed description, drawing figures, and appended claims.

The novel features of this invention and the invention itself, both in structure and operation, are best understood from the accompanying drawing considered in connection with the accompanying description of the drawings.

DESCRIPTION OF THE PREFERRED EMBODIMENT

Figure 1:
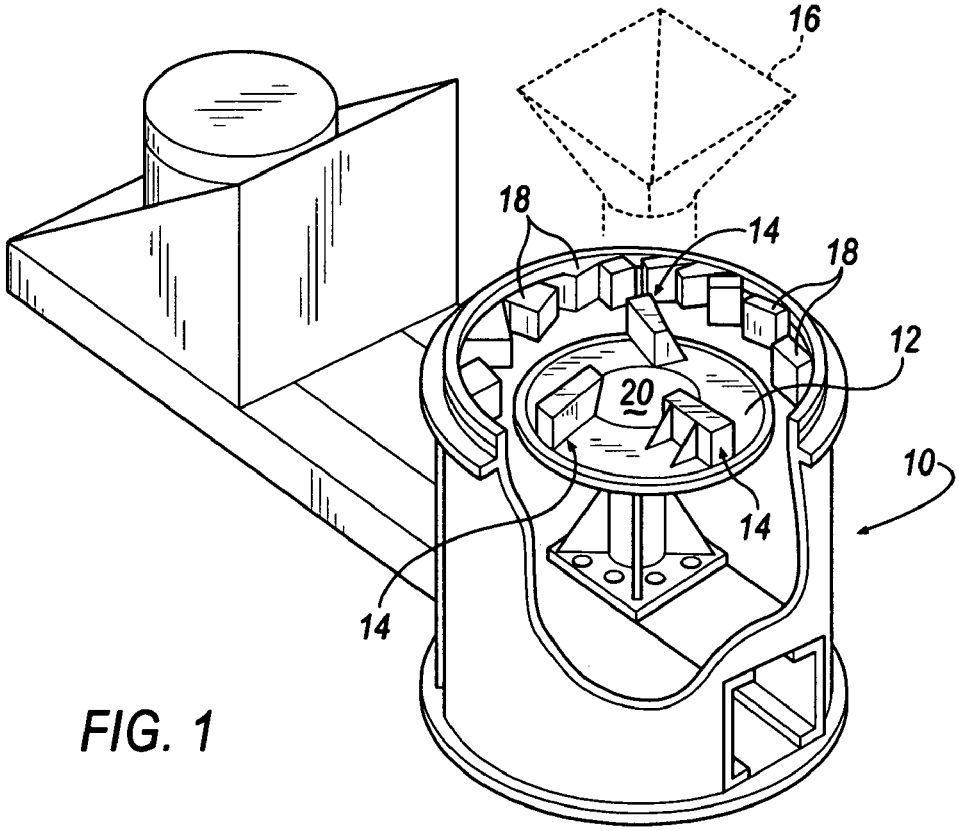
FIG. 1 is a perspective view of a component of an impact crusher machine of the type employing the impeller shoes and conical center feed body of the present invention.

Referring now to FIG. 1, a vertical shaft impeller rock-crushing machine 10 includes an impeller turntable 12 which revolves at a high speed about a central shaft (not shown). Impeller blade shoes 14 are affixed to the turntable 12 at regular intervals along its surface. Rock or other aggregate (not shown) drops onto the turntable from a funnel 16 located above the turntable, and the centrifugal force caused by the rotating shoes 14 slings the rock outwards causing it to strike a series of anvils 18 and be crushed. Initially the rock or aggregate falls on a central feed body 20 of the turntable 12 but as the turntable is rotating, the rock spreads outward along the central feed body 20 forming streams of material, particulate in nature, which flow across the wear surfaces of each of the impeller blade shoes 14. The impeller shoes 14 and central feed body are mounted to the impeller table by methods well known in the industry.

Figure 2:
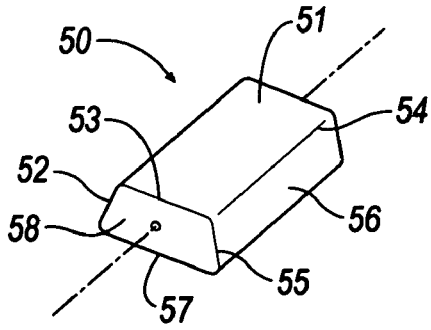
FIG. 2 is a perspective view of a hard material bar of the present invention impregnated within impeller shoes and center feed body of the present invention.
Figure 3A:
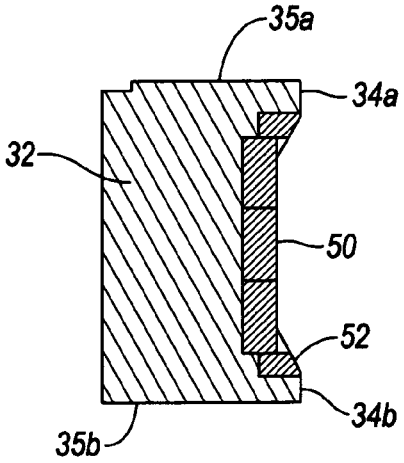
FIG. 3A is a cross sectional view taken along line 3A—3A in FIG. 3.
Figure 3:
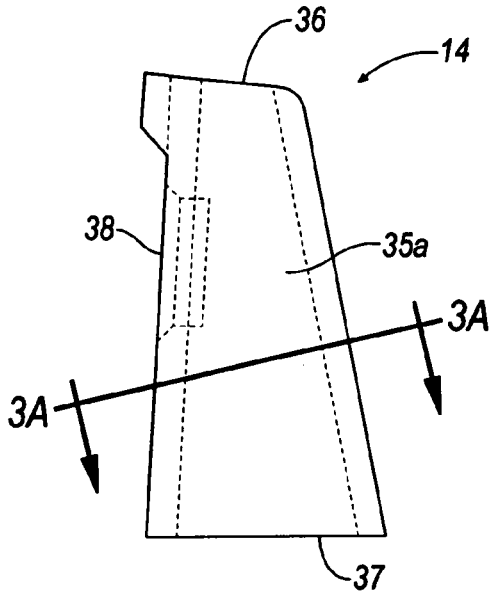
FIG. 3 is a top view of an impeller shoe embodiment of the present invention.
Figure 4A:
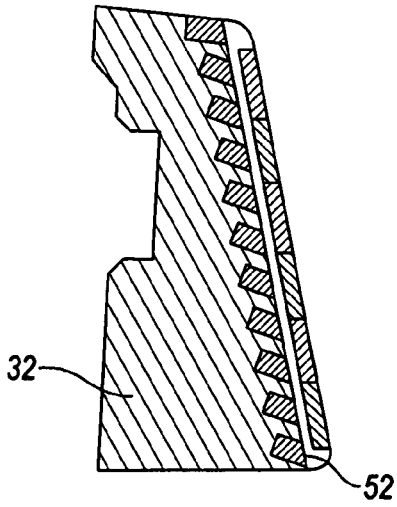
FIG. 4A is a cross sectional view taken along line 4A—4A in FIG. 4.
Figure 4:
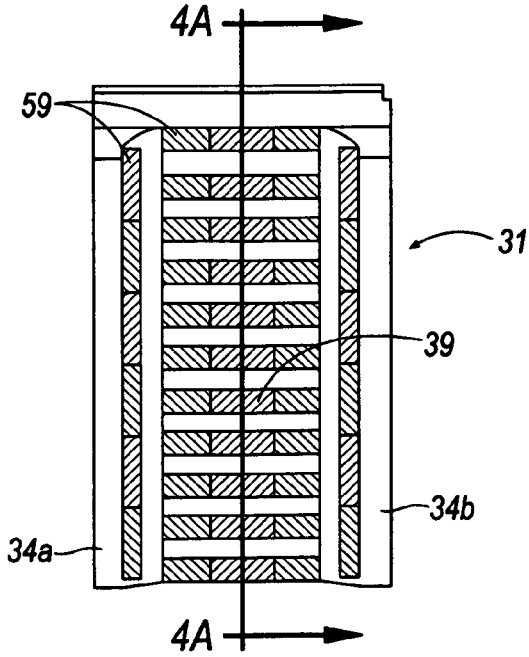
FIG. 4 is a side view of the impeller shoe embodiment shown in FIG. 3.
Figure 5:
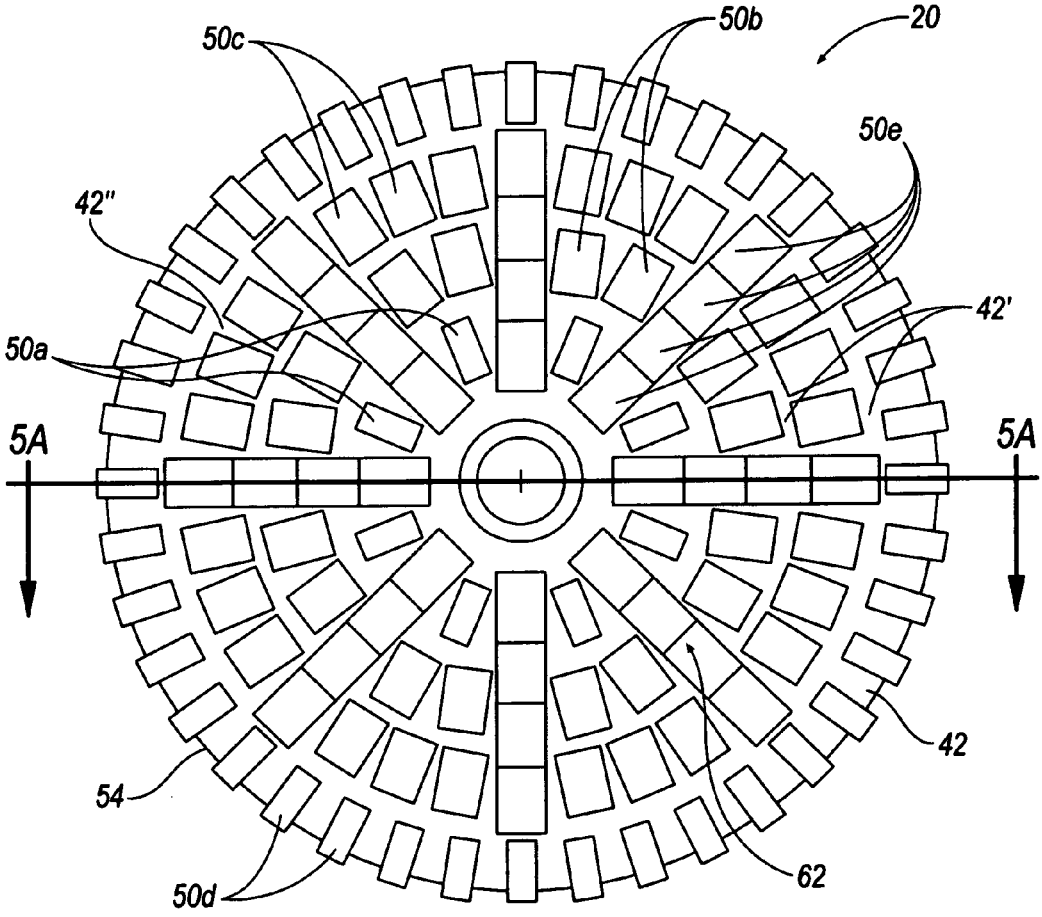
FIG. 5 is a top view of a central feed body of the present invention incorporated with the impact crusher machine shown in FIG. 1.
Figure 5A:
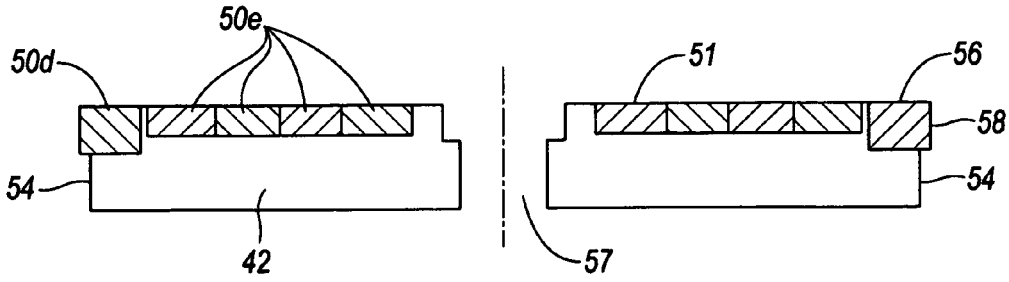
FIG. 5A is a cross sectional view taken along line 5A—5A in FIG. 5.

FIGS. 3, 3A, 4 and 4A disclose an impeller shoe 14 and FIGS. 5 and 5A disclose a central feed body 20. It should be appreciated that the employed materials, general construction and method of making both the impeller shoe 14 and central feed body 20 are applicable to both and also to other components on any and all equipment exposed to aggregate material flow in any industry, including construction and mining. It is contemplated for instance that the anvils and table plates on the impeller crusher could also be made in accordance with the following description. The impeller shoe 14 and central feed body 20 of the present invention are impregnated with a plurality of hard material block bars 50 as illustrated in FIG. 2.

In both the impeller shoe and central feed body of the present invention, hard abrasive resistant inserts such as tungsten-carbide inserts are appropriately positioned along the exposed surfaces of a steel cast central feed body 20 or the impeller shoe 14 mold so that the molten steel during casting flows into spaces between and around the tungsten-carbide insert bars, trapping them in a composite matrix. The central feed body housing 42 or the shoe housing 32 can be made from "white iron." In the crusher industry, the term "white iron" is used to identify a commonly used alloy of chromium and iron consisting essentially of 27% chromium with the balance in iron and trace materials. The chromium content can vary from between 25%–29%. Other well-known wear resistant alloys in the construction industry could alternatively be used to manufacture the shoe housing 32 and manufacture the central feed body housing 42. Alternatively, the impeller shoe 14 and central feed body 20 discussed above may be made of air hardened steel as described in U.S. Pat. No. 5,279,902, or other suitable steel alloy having desirable wear characteristics.

The steel alloy used to cast the impeller shoe 14 and central feed body 20 may be constructed entirely of air hardened steel, an example of an appropriate air hardened steel is described in U.S. Pat. No. 5,279,902, which is hereby incorporated by reference in its entirety. It is also contemplated that the impeller shoe 14 and central feed body 20 may be constructed from a composite of steels for instance, the external body sections that are closer to the surfaces of the body subjected to material flow and wear may be constructed from an alloy with a higher abrasion resistance than more internal body sections that generally are not subjected to material flow during the usable lifetime of the impeller component. For instance it is contemplated that in one embodiment an SAE 8740 steel could be used for the internal body sections and a higher carbon SAE 8760 steel for the external body sections, or SAE 8720 for the internal body sections and SAE 8740 steel for the external body sections. Similarly, SAE 15B37 could be employed for the internal body sections and SAE 15B45 for the external body sections, or a SAE 4140 steel for the internal section and a SAE 4160 for the external section. In each of the examples given the external section and internal section are made from a steel alloy having the same general composition except for the external section has a higher carbon percentage. As well known in the industry, steel alloys with a higher percentage of carbon are harder than steels having a lower percentage of carbon.

The block bars 50 are constructed from a hard material such as a carbide or other hard material composition having wear resistant properties greater than "white iron". The block bars 50 may be manufactured by powder metallurgy techniques. However, manufacture of one or more block bars 50 by powder metallurgy techniques is merely one method of manufacture of block bar 50 in connection with the present invention, it is not intended to be exclusive, and is not a limitation of the present invention. Bars 50 have a longitudinal axis and may be manufactured by combining a powder such as tungsten carbide with a binder such as cobalt, nickel or other similar chemical compositions. The powder and binder may be blended and compacted in a press or similar device. For some applications the bars can be made of a highly wear resistant cemented tungsten carbide as disclosed in U.S. Pat. No. 4,859,593, to Greenfield et al. U.S. Pat. No. 4,859,593, to Greenfield et al., is hereby incorporated into the specification in its entirety. In a preferred embodiment of the invention the hard material insert means are a cemented tungsten carbide 6% Cobalt, with properties of 88–93 HRA, 14.95 gm/cc density, 1–10 micron grain size, 100 Oe and 13.20 $MPa^{1/2}$ K1C fracture toughness. The cobalt composition is not strictly limited to 6% but may fall within the range of 5.5%–16.0%, alternatively for applications requiring increased wear resistance 5.5%–9.0%, the cobalt alternatively for other applications requiring better toughness it might fall within the range of 11.0%–14.0%. The impeller shoe 14 illustrated in FIGS. 3–4A, according to the present invention, includes at least one surface, front face 31, exposed to a material flow during operation of the apparatus. The impeller shoe shown in FIGS. 3, 3A, 4, and 4A also includes a front face 31, shown in FIG. 4, a top surface and bottom surface, 35*a* and 35*b* respectively, an upstream surface 36 and a downstream surface 37 and a mounting surface 38. The mounting surface includes a recessed cavity (shown in phantom lines) for guiding/mounting the impeller shoe to a support frame integral with the turntable 12. As will be evident from one skilled in the art, impeller shoe 14 may have more than one surface which, during operation, is exposed to wear The other surfaces, such as top surface and bottom surface, 35*a* and 35*b* respectively, upstream surface 36 and a downstream surface 37 may be exposed to wear arising on account of materials rebounding and bouncing in all directions inside the impeller. It is contemplated that hard material bars may also be impregnated on the top surface and bottom surface, 35*a* and 35*b*, upstream surface 36 and downstream surface 37 as well to limit such wear.

FIG. 4 best illustrates the front face 31 of the impeller shoe. The front face 31 includes a top siderail 34*a*, a bottom siderail 34*b*, each having a longitudinal axis and a generally flat central portion 39 located between the siderails 34*a*, 34*b*. The front face 31 and the top/bottom siderails 34*a*, 34*b* are generally the only surfaces exposed to direct material flow, excluding rebounding and random indirect material impact. The impeller shoe includes a plurality of hard material bars 50 impregnated in the shoe body 32. All of the impregnated bars on the front face are shown cross hatched. The portions of the front face 31 free from cross-hatching represent the shoe housing 32 surfaces made from "white iron" or other suitable alloy as discussed above. The central portion 39 is generally flat and includes a plurality of hard material bars 50. In this embodiment, there are three bars 50 in each of the plurality of rows. For purposes of this invention, the number of rows and number of block bars 50 in each row may vary so long as a large portion of the surface area of the front face 31 exposed to direct material flow includes hard material bars 50. The percentage of exposed surface area of the front face 31 that is comprised of hard material is within the range 40% to 95%. In the alternative and depending upon the specific application, the percentage of exposed surface area comprised of hard material is a specified amount between about 80 percent and about 95 percent of the overall exposed surface area of the hard composite. In one embodiment the percentage of exposed surface area comprised of hard material may be present at about 92 percent of the overall exposed surface area.

As illustrated in FIG. 2 of the disclosed invention, the hard material block bar 50 is not rectangular. The end face 58 is not rectangular, it has a first short edge 55, a second long edge 57 that is oriented generally orthogonal to the first short edge 55 and another third edge 53 also orthogonal to the first edge 55, and a fourth edge 52 oriented at an angle with respect to both the third edge 53 and second edge 57. Some or all of the edges are rounded, see 54. Each of the six surfaces of the bar is generally flat and rectangular. As best seen in FIG. 4A the hard bars 50 are oriented at an angle, within the range of 3°–30°, so that the first contact surfaces 59 of the bars 50 are generally coplanar with the central portion 39. Along the inner sidewall of each rail 34*a*, 34*b* is included a row of hard material block bars 50 for protecting the inner sidewall from wear caused by material flow. The bars 50 along the siderails 34*a*, 34*b* are oriented so that the first contact surfaces 59 diverge upward and away from the central portion 39 of the front face. The longitudinal axis of each of these bars 50 is aligned to be parallel to the longitudinal axes of the siderails.

The bar shape 50 depicted in FIG. 2 is merely representative of one embodiment of a bar shape for an impeller shoe and central feed body and to help disclose the present invention, and is not intended to limit the scope of application of the present invention. Also in FIG. 2, the first contact surface, second contact surface and third contact surface of the block bars are flat. However, as will be evident to one skilled in the art, the flat shape of the first contact surface 52 and 51 of the bar 50 is not a limitation on this invention.

The embodiment illustrated in FIGS. 5 and 5A illustrates the central feed body housing as being generally a flat disc; however, it is contemplated that the central feed body housing may be a conical, plate, convex or other shape. The central feed body housing 42 comprises of a lower portion and an upper portion. The lower portion of the central feed body housing may be constructed entirely of air hardened steel, an example of an appropriate air hardened steel is described in U.S. Pat. No. 5,279,902, which is hereby incorporated by reference in its entirety, and the upper portion of the central feed body housing comprises hard material block bars 50 embedded in the same air hardened steel forming a composite matrix. During manufacturing of the central feed body 20, the bars 50 are positioned according to a preselected pattern in the mold then a melted alloy is poured into the mold filling the voids between the carbide particles and diffusing therewith to form a cemented carbide particle composite matrix, see U.S. Pat. No. 4,024,902, which is herein incorporated by reference.

The top view of the central feed body disc is illustrated in FIG. 5 and a cross-section of said disc is shown in FIG. 5A. The central feed disc 20 includes a central cylindrical bore 57 having a concentric recessed flange for receiving a cooperating member to align the central feed disc as is well-known in the art. A plurality of bars 50 is shown in FIG. 5 (not cross hatched). A first concentric ring of insert bars 50*a* surrounds the cylindrical bore 57, a second concentric group of insert bars 50*b* immediately adjacent the first ring surrounds said first concentric group of insert bars 50*a*. A third concentric group of insert bars 50*c* surrounds the second group followed by a fourth outer concentric group of insert bars 50*d*. In the embodiment disclosed in FIGS. 5–5A, the bars 50 are oriented so that the elongated central axis, see FIG. 2, of the bars are each oriented in a radial direction relative to the disc. The disc 20 in this embodiment has six (6) radial spokes 62 equally spaced about its central axis but may have between 1–36 spokes depending on the size and application of the central feed body. Each spoke extends from generally adjacent to the central axis of the disc toward the outer peripheral surface 54 of the disc. The spokes in this embodiment 62 comprise of four bars 50*e* arranged to abut against each other. The bars 50*e* that form the spokes are oriented so that third contact surface 51 is the exposed surface of the disc that the material flows across during operation. In this embodiment, between adjacent spokes are five bars 50*c* that, similar to the spoke bars 50*e*, are also oriented with third contact surface 51 exposed to the material flow. The number of block bars 50 in each concentric group, each spoke or between adjacent spokes should not be construed to be limiting but is only specific to the illustrated embodiment in FIGS. 5 and 5*a*. It is contemplated that, for central feed discs 20 having different sizes and/or block bars 50 having different sizes or central feed discs designed for different applications, the number of block bars 50 in each concentric group, each spoke or between adjacent spokes will vary.

During operation of the impeller, as material is fed into the hopper it lands upon the central feed disc 20, the material moves radially outward due to the centrifugal force caused by the rotation of the central feed disc 20. As the material flows radially outward across the top surface of the central feed disc, it acquires a velocity. The velocity includes both a radial component and a tangential component, orthogonal to the radial direction.

The top exposed surface of the central feed body 20 upon initial installation inside an impeller 10 is generally a smooth flat surface. During operation of the impeller 10, as the material flows across the top exposed surface of the central feed body 20 it results in wear to both the hard material bars 50 and softer feed body alloy 42. The softer feed body alloy 42 wears at a greater rate than the hard material bars 50 resulting in recesses being formed between the hard material bars 50. Smaller material particles flowing across the central feed body disc fall into the recesses formed between hard material bars 50. The material flow that penetrates into these recesses in the central feed disc 20 causes the softer feed body alloy 42', 42" between bars 50 to wash out. As can be appreciated, as the softer feed body material continues to wash out during use, the recesses between hard material bars 50 become deeper. Because the central feed body material 42', 42" in the recess spaces continues to wash out the material will have a greater propensity to flow both concentrically in the recess space 42' between adjacent bars 50 in different concentric groups and also radially in the space 42" between adjacent bars within the same concentric group.

As best seen in FIG. 5 of the present invention, the insert bars 50 in each progressive downstream group of concentric insert bars 50, are positioned so that the central longitudinal axis of the bar 50 is generally in the same plane as the central longitudinal axis of an immediately adjacent upstream radial recess. By centrally locating the center of the bars 50 in the next downstream concentric group of bars 50 so that these bars substantially bisect the radial recess formed between two bars in the concentric group immediately adjacent thereto, any radial flow of material in the gap/spaces 42" between adjacent insert bars is intercepted. The intercepting insert bars 50 in the next downstream concentric group function to dam and disperse the material flow over top and across the intercepting hard material insert bars. This change in direction of the material flow, it is believed, reduces the wash out rate of the softer feed body material that holds the insert bars 50 in place. Such placement of bars in adjacent concentric groups assists in reducing premature failure of the central fee disc 20 on account of wash out.

Similarly, the propensity of concentric material flow within concentric recesses increases as the softer feed body alloy 42' therein continues to wash out. The insert bars 50*e* that form the spokes 62 of the disc 20 in the present invention function in a similar manner to the intercepting insert bars described immediately above. The spoke insert bars 50*e* dam and disperse any concentric material flow that may develop in the concentric recesses between adjacent concentric groups of bars 50. The spoke bars 50*e* help to prevent premature failure caused by accelerated wear by wash out. The spokes function similar to radial vanes on an impeller and sling the material outward at a greater velocity in comparison to material flowing across a smooth central feed disc. It is believed that this greater velocity, generated by the spokes 50*e*, assists in increasing the overall velocity of the material. This greater velocity improves the amount of disintegration that occurs upon impact of the material with impeller anvils 18. Further, it is believed that on account of the greater velocity of the material prior to contacting the impeller shoes the relative change in velocity, acceleration, of the aggregate material imparted by the impeller shoes 14 is reduced. This reduction in acceleration of the aggregate material by the impeller shoe, it follows reduces the normal force component applied to the impeller front face 31. This smaller normal force applied to the front face 31 it is believed reduces the wear rate of the impeller shoe 14.

Closer to the center of the central feed body disc 20 and between spokes 62 are six bars 50*a* that are positioned during casting so that the second contact surface 56 is oriented so as to be exposed to material flow across the central feed body. Generally near the outer periphery of the central feed disc 20 are a plurality of bars 50*d* that are similarly oriented with the second contact surface 56 oriented so as to be exposed to the material flow. In FIG. 5 the plurality of bars 50*d* are formed so that the end face 58 of each bar 50*d* extends beyond the peripheral surface 54 of the disc it is contemplated that alternatively the end face 58 could be flush with the surface 54.

The plurality of bars 50*d* made from hard material are attached to protect the softer material of the peripheral side surface 54 of the center feed body disc 20 from undercutting wear caused by material flow rebounding off anvils and shoes back toward the center of the impeller rock crusher.

The melted alloy used in this invention is a steel exhibiting acceptable hardness and impact toughness is prepared generally according to standard molten steel casting procedures well known in the art before being poured into the cast mold.

It is contemplated that a material other than cemented carbide may be used for forming the bars 50. The bars 50 can be made from a ceramic material or other well-known material in the construction industry. However, the materials used for the bars must be harder than the alloy used to make the central feed body housing.

It is contemplated that that cemented carbide particles, as disclosed in commonly owned patent application Ser. No. 10/067,021, can be employed in the impeller shoe 14 and central feed body 20 of the present invention. It is believed that the carbide particles together with, insert bars and the steel body (of shoe or central feed body) would form a steel alloy composite matrix that significantly reduces the rate at which the housing material holding the bars 50 are eroded or "washed out" by the aggregate materials being crushed. Copending patent application Ser. No. 10/067,021, to Gary J. Condon, filed Feb. 4, 2002, is hereby incorporated in its entirety.

The capacity of central feed body 20 according to the present invention, to reduce wear caused by a material flow, is not solely affected by the spacing distance that bars are positioned adjacent each other. The effectiveness of central feed body 20, according to the present invention, to reduce wear by a material flow, is a function in part of the spacing distance between hard material bars 50 on the central feed body, as well as the design, number, shape, configuration and location of the bars 50 on the central feed body 20 in relation to angles of incidence of a material flow against, over and around the central feed body 20, and the alloy composition of bars 50. Also, it should be appreciated that the hard material compositions used in the bars does not have to be used consistently throughout either the impeller shoe or central feed body. Bars that are positioned on the shoes 14 or central feed bodies 20 that are subjected to greater wear may be fabricated from compositions having greater wear resistance than bars positioned at other locations on the shoe or central feed body.

Further, as should be apparent for impeller shoes and central feed discs of different sizes and/or insert bars of different sizes, the number of insert bars, concentric groups and spokes may vary. It is also contemplated in the present invention that alternative feed body discs with different preselected patterns employ insert bars having exposed surfaces uniformly oriented within the same horizontal plane, and that accounted for a large portion of the total exposed surface area of the central feed disc, would outperform the prior art. Likewise, it is also contemplated that the preselected pattern of the insert bars in the embodiment illustrates in FIGS. 3–4A should not be limiting.

The novel features of this invention and the invention itself, both in structure and operation, are best understood from the accompanying drawings considered in connection with the accompanying description. It should be noted that the illustrated embodiments and corresponding description are merely one of many designs for the invention and merely representative of an application of the invention for an impeller rock crusher. It is contemplated for instance that the disclosed invention would also have application for not just the open impeller system described above, but also for closed impeller systems. The invention is not intended to be limited to the disclosed embodiments and description herein.

What is claimed is:

1. A rock-crushing machine for hurling aggregate material toward anvils said rock-crushing machine comprising a central feed body housing having a central axis, a top surface and a peripheral surface, wherein said top surface includes a plurality of hard material insert bars, said bars integrally fixed within said housing in a preselected pattern comprising:

a) a plurality of radially directed spoke insert bars wherein said spoke insert bars abut against each other and extend radially from said central axis; and b) a plurality of concentric groups of intercepting insert bars, wherein said top surface includes a radial recesses between said intercepting insert bars in each group, wherein each radial recess has a central longitudinal axis, and wherein each said radial recess central longitudinal axis intersects with an intercepting insert bar in an adjacent concentric group.

2. The rock-crushing machine according to claim 1 wherein said central feed body housing is constructed from air hardened steel.

3. The rock-crushing machine according to claim 1 wherein said insert bars in an adjacent downstream concentric group are centrally positioned to dam and disperse the radial direction material flow over top and across the centrally positioned hard material insert bars.

4. The rock-crushing machine according to claim 1 wherein said spoke insert bars dam and disperse the concentric direction material flow.

5. The rock-crushing machine according to claim 1, wherein a group of said insert bars extend beyond said peripheral surface.

6. The rock-crushing machine according to claim 5 wherein said group of insert bars are concentric with the central axis.

7. The rock-crushing machine according to claim 6 wherein said insert bars are made from a cemented tungsten carbide.

8. The rock-crushing machine according to claim 1 wherein said insert bars are made from a cemented tungsten carbide.

9. The rock-crushing machine according to claim 1 further comprising:

an impeller shoe having a plurality of said hard material insert bars.

10. The rock-crushing machine according to claim 9 wherein said impeller shoe includes a front face having two side rails and a central flat portion between said side rails, said side rails each have a longitudinal axis.

11. The rock-crushing machine according to claim 10 wherein said plurality of bars have a longitudinal axis, a portion of said plurality of insert bars are fixed within said two side rails so each of the longitudinal axes of said portion of plurality of bars is parallel to the longitudinal axes of said two side rails.

12. A rock-crushing machine for hurling aggregate material toward anvils, said rock-crushing machine comprising:

a shoe comprising a shoe housing body having a front face having two side rails and a central flat portion between said side rails, said side rails each have a longitudinal axis, wherein said body includes a plurality of hard material insert bars integrally fixed within said housing in a preselected pattern, wherein said insert bars have six generally flat surfaces including two end faces, a first contact surface, a second contact surface and a third contact surface and wherein said first contact surface is oriented at an angle with respect to said third contact surface.

13. The rock-crushing machine according to claim 12 wherein said first contact surfaces of said plurality of bars in said central portion are oriented to be coplanar with said flat central portion.

14. The rock-crushing machine according to claim 13 wherein said plurality of bars have a longitudinal axis, a portion of said plurality of insert bars are fixed within said two side rails so that each of the longitudinal axes of said portion of plurality of bars are parallel to the longitudinal axes of said two side rails.

15. The rock-crushing machine according to claim 14 wherein said first contact surfaces of said insert bars are oriented to diverge outward from said central portion at said angle.

16. The rock-crushing machine according to claim 12 wherein said insert bars have a longitudinal axis and are fixed within said central flat portion of said impeller shoe so that said longitudinal axes of said insert bars within the central portion are generally orthogonal to said longitudinal axis of said side rails.

* * * * *